US006026746A

United States Patent [19]

Andaloro

[11] Patent Number: 6,026,746

[45] Date of Patent: Feb. 22, 2000

[54] LOCK-UP ASSEMBLY FOR PLATE CYLINDERS OF ROTARY PRESSES

[75] Inventor: Frank A. Andaloro, Pawcatuck, Conn.

[73] Assignee: E. R. Smith Associates, Inc., Westerly, R.I.

[21] Appl. No.: 09/158,561

[22] Filed: Sep. 22, 1998

[51] Int. Cl.[7] ..... B41F 27/12

[52] U.S. Cl. ..... 101/415.1

[58] Field of Search ..... 101/415.1

[56] References Cited

U.S. PATENT DOCUMENTS

| | | | |
|---|---|---|---|
| 1,644,218 | 10/1927 | Wright | 101/415.1 |
| 1,937,119 | 11/1933 | Kranz | 101/415.1 |
| 2,285,116 | 6/1942 | Grupe | 101/415.1 |
| 2,409,536 | 10/1946 | Braunworth | 101/415.1 |
| 2,953,090 | 9/1960 | Scott | 101/415.1 |
| 3,008,410 | 11/1961 | Bryer | 101/415.1 |
| 3,757,690 | 9/1973 | Skiera et al. | 101/415.1 |
| 4,476,783 | 10/1984 | Tsukasaki | 101/415.1 |
| 4,688,473 | 8/1987 | Eriksson | 98/79 |
| 4,688,483 | 8/1987 | Schollenberger | 101/415.1 |
| 4,688,484 | 8/1987 | Herold et al. | 101/415.1 |
| 4,951,568 | 8/1990 | Tsukamoto et al. | 101/415.1 |
| 5,178,068 | 1/1993 | Junghans et al. | 101/415.1 |
| 5,315,931 | 5/1994 | Doersam | 101/415.1 |
| 5,402,722 | 4/1995 | Schneider et al. | 101/415.1 |
| 5,413,042 | 5/1995 | Weiss et al. | 101/415.1 |
| 5,461,981 | 10/1995 | Schneider | 101/415.1 |
| 5,503,072 | 4/1996 | Schneider | 101/415.1 |

*Primary Examiner*—Ren Yan
*Assistant Examiner*—Leslie J. Grohusky
*Attorney, Agent, or Firm*—Cohn, Powell & Hind

[57] ABSTRACT

In offset presses in which the printing cylinder is provided with a tensioning spindle or reel rod the printing plate usually has a hooked edge which is inserted in a gap in the printing cylinder. The printing plate is then wrapped around the plate cylinder for insertion in the spindle within the plate cylinder. The tensioning spindle carries a slot for receiving an end of the printing plate. After insertion of the plate end in this receiving slot partial rotation of the spindle tightens the printing plate. A substantial amount of skill is required to fix a printing plate on a printing cylinder. It is not easy to align the gap in the printing cylinder with the slot in the tensioning spindle. Two hands are usually required. Herein the tensioning spindle end shaft carries a pinion capable of moving a rack associated with it when the tensioning spindle is partially rotated. A spring is installed to oppose the rack movement. A ratchet mechanism is provided to hold the tensioning spindle in place after the slot and gap are aligned. The edge of the printing plate can readily be inserted in the tensioning spindle receiving slot. A ratchet release means permits the spring, through the rack, to rotate the tensioning spindle to lock the printing plate in place under a tensioned condition from either end of the printing cylinder.

10 Claims, 4 Drawing Sheets

LOCK-UP ASSEMBLY FOR PLATE CYLINDERS OF ROTARY PRESSES

BACKGROUND OF THE INVENTION

This invention, in general, relates to rotary printing presses, for instance offset presses, and similar rotary presses. In a more specific aspect the invention pertains to lock-up assemblies for securing printing plates on the plate cylinders of such presses.

As explained in U.S. Pat. No. 4,688,483 there are two types of procedures for fastening printing plates on plate cylinders, also termed blanket cylinders or platen cylinders. One procedure entails securing the leading edge of the printing plate to the plate cylinder while the trailing edge lies freely on the cylindrical surface. In the second procedure the plate cylinder is provided with clamping units which grasp both the leading and trailing edges of the printing plate. This invention relates to this second procedure. Clamping mechanisms for effecting these procedures might also be categorized in two groups, those utilizing tensioning spindles—also known in the art as reel rods—and those utilizing other printing plate gripping and tightening means. Patents employing means other than tensioning spindles are exemplified by U.S. Pat. Nos. 1,937,119, 2,285,116, 4,688,473, 4,688,484 and 5,413,042.

It is clamping assemblies using tensioning spindles or reel rods with which this invention is concerned. Examples of these mechanisms are U.S. Pat. Nos. 3,757,690, 4,476,783, 4,951,568, 5,178,068, 5,315,931, 5,402,722, 5,461,981, and 5,503,072. In the utilization of offset presses in which the printing cylinder is provided with a tensioning spindle or reel rod, the first end of the printing plate usually has a hooked edge which is inserted in a holding gap in the printing cylinder. The printing plate is then wrapped around the printing cylinder and connected at a second end to a tensioning spindle, commonly known as a reel rod, disposed within the plate cylinder. The reel rod carries a slot for receiving the second end of the plate. After insertion of that plate end in this receiving slot, partial rotation of the reel rod tightens the printing plate. The tightening operation is quite critical because, as is generally known, the printing plate must be held on the printing cylinder with a certain amount of tension to ensure that it will stay in place and will not shift during the printing operation. Such shifting can have a detrimental effect on the quality of the material printed by the press. Due to inaccurate tensioning some reel rods also can distort or tear the printing plate during the tensioning operation.

It is to be appreciated, then, that, as emphasized in U.S. Pat. No. 5,315,931, a substantial amount of skill on the part of the press operator is required to apply a printing plate to a plate cylinder. Frequently, one of the printing plate's edges can slip out of the holding gap in the printing cylinder before the other edge of the printing plate can be inserted into the receiving slot in the reel rod, where it is to be tensioned. This is particularly the situation when the cylinder is being rotated in order to wrap the printing plate around it. For this reason, in many instances at least two operators must attend to the placement of the printing plate on the printing cylinder. As pointed out in U.S. Pat. No. 4,476,783 one operator holds the printing plate, and the other engages the plate in its gap and slot while also trying to stretch the printing plate. In addition tools such as wrenches or drivers are frequently required. Another disadvantage of present lock-up assemblies is the difficulty of maintaining the gap in the printing cylinder in alignment with the slot in the reel rod while removing or installing the printing plate. In fact, the alignment process itself is not without problems. It can be seen, then, that there is a definite need for a press printing cylinder carrying a reel rod which overcomes these limitations. The clamping device herein is directed to that end.

SUMMARY OF THE INVENTION

In order to render it possible for one operator to tighten a printing plate around a plate cylinder in an offset printing machine, for example, a clamping device or lock-up assembly is provided herein. The clamping device contemplates a plate cylinder having a recess in its periphery in the form of a longitudinal gap across the surface of the plate cylinder. The plate cylinder gap is adapted to receive leading and trailing edges of a printing plate and it opens into a channel below it. The channel below the gap is adapted to house a tensioning spindle or reel rod. This reel rod is mounted for partial rotation on an axis parallel to the cylinder axis of rotation. The reel rod is provided with a printing plate edge receiving slot. This slot is adapted, when the receiving slot is in alignment with the plate cylinder longitudinal gap, to engageably receive and hold an edge of the printing plate. On each end, the reel rod carries a pinion which is capable of moving a rack associated with it when the reel rod is partially rotated in order to align the reel rod receiving slot with the plate cylinder longitudinal gap. A spring is installed to oppose the rack movement during the partial rotation of the reel rod. A ratchet holding means is provided to hold the reel rod in place after alignment. The edge of the printing plate can then readily be inserted in the reel rod receiving slot. A ratchet release means permits the spring, through the rack, to rotate the reel rod to a locked position to hold the printing plate in place.

In one aspect of the invention, the ratchet holding means is a pawl.

It is a particular advantage of this lock up assembly that locking may be performed by a single operator from either end of the plate cylinder.

The improved lock-up assembly thus far briefly described can be better understood from a description thereof in conjunction with the accompanying drawings.

DESCRIPTION OF THE DRAWINGS

In these drawings

DETAILED DESCRIPTION OF THE INVENTION

Figure 8:
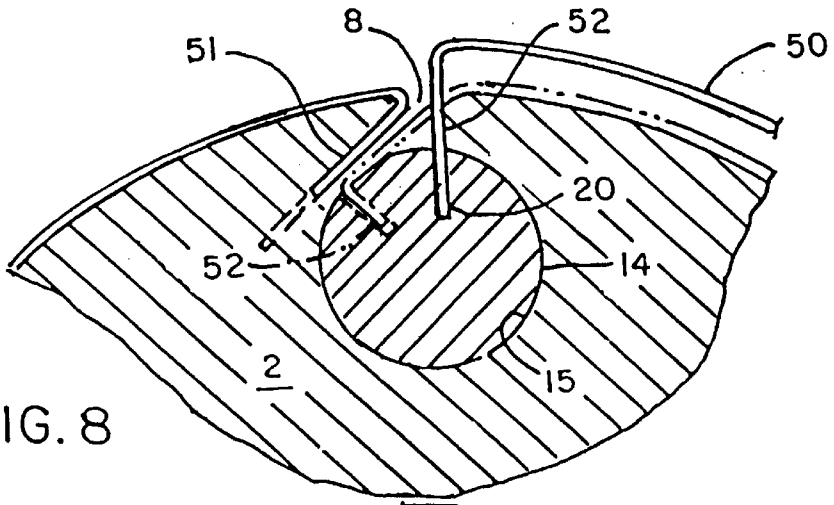
FIG. 8 is a fragmentary cross-sectional view of the plate cylinder showing the configuration of the gap and the reel rod slot.
Figure 5:
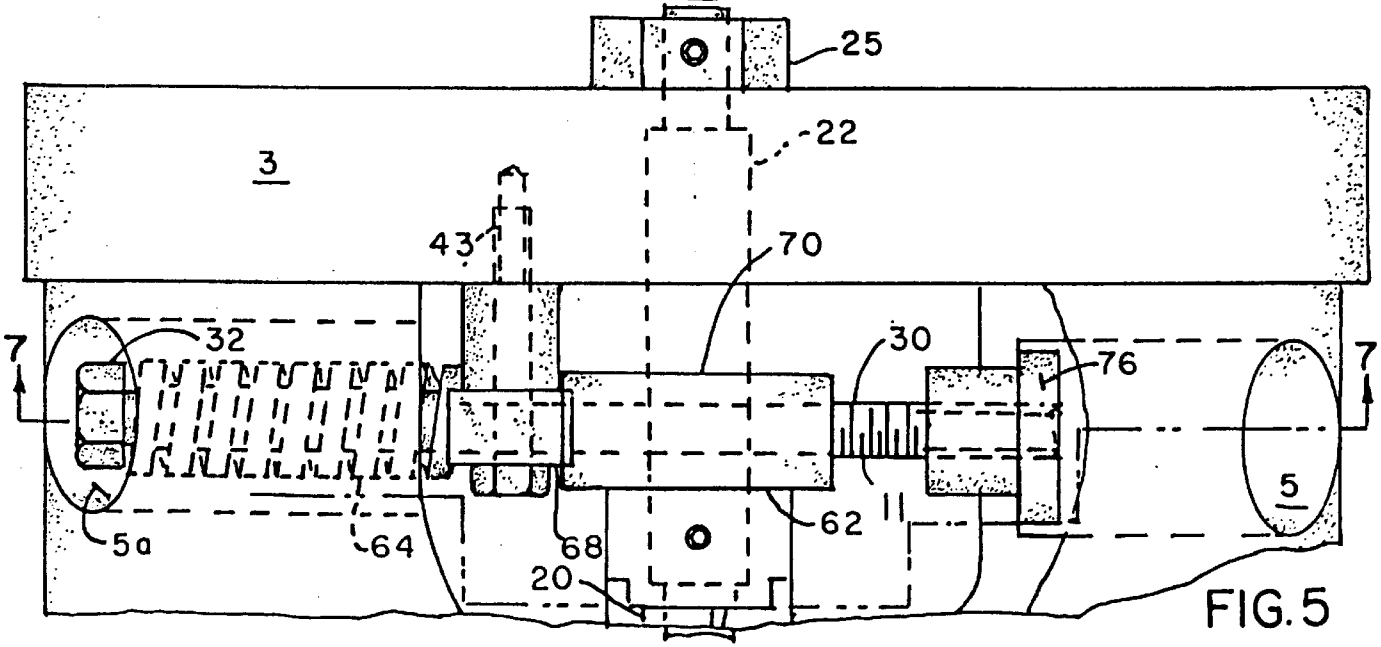
FIG. 5 is a view similar FIG. 3, but showing a modified rack and pinion means associated with the reel rod of FIGS. 1 and 2.

In rotary printing presses of the type alluded to herein printing plates made of thin metals, such as copper, zinc or aluminum, plastics, such as polyesters, heavy papers, such as resin coated paper films are provided with surfaces which define the images to be printed. As shown in FIG. 8, the length of each printing plate 50 between edges 51 and 52 is slightly longer than the circumference of the plate cylinder so that it can be carried by a rotatable plate cylinder in a printing unit. Ink is applied to the printing plate on the printing cylinder, and the inked images are transferred to a blanket cylinder (not shown) which transfers the images to paper or other material when the printing cylinder rotates during the printing operation. In rotary printing presses, then, it is generally conventional to secure the printing plates to the outer peripheral surface of the rotatable printing plate cylinder. This invention resides broadly in such print unit cylinders for rotary presses.

Figure 1:
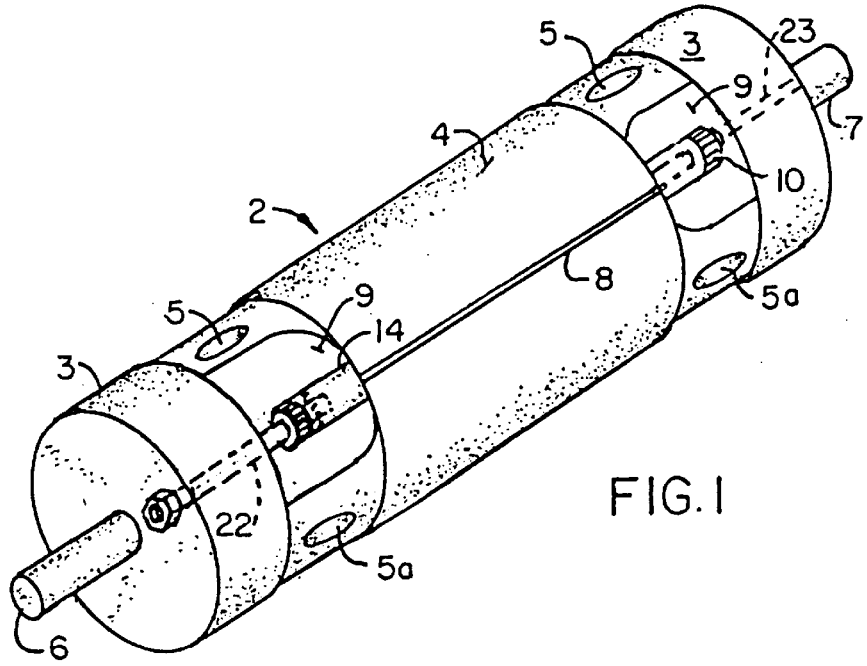
FIG. 1 is an isometric view of a type of plate cylinder commonly employed in rotary printing presses.
Figure 2:
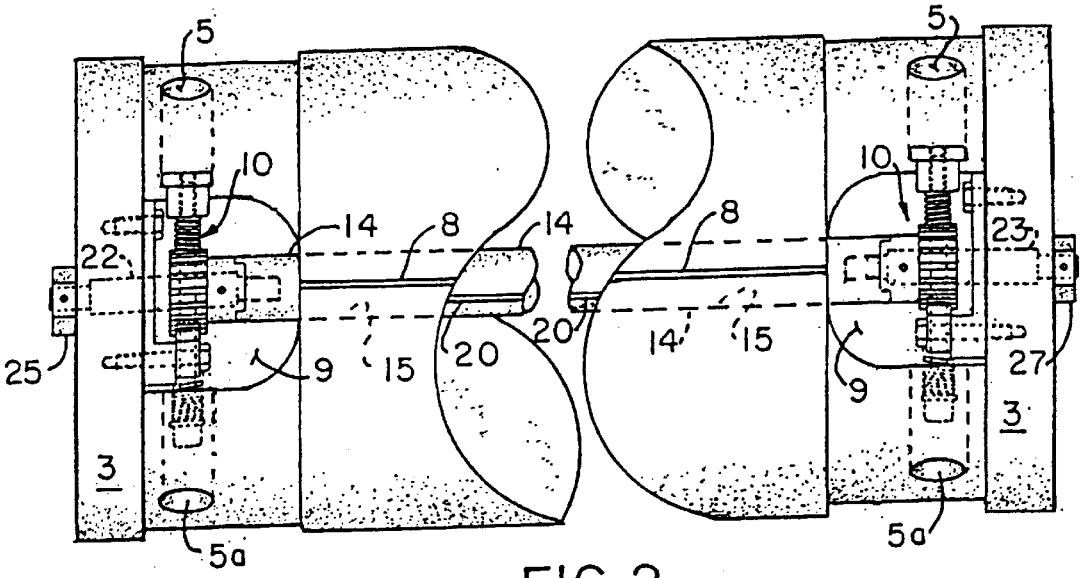
FIG. 2 is a fragmentary top view of a plate cylinder showing the tensioning spindle mechanism.

As an example, we refer to printing plate cylinder 2 having a cylindrical body with a longitudinal central axis illustrated in FIG. 1. Printing plate cylinder 2 is provided with a surface 4 adapted to receive the printing plate, and with a bearer ring 3 which permits pressure adjustments. Each end of plate cylinder 2 is provided by studs 6 and 7. The studs are receivable in bearings (not shown) which support the plate cylinder in the rotary printing press for rotation about the cylinder axis. The plate cylinder is symmetrical about its axis or center line, and in the embodiment shown there are recesses 9 near each end provided with upper and lower counter bore portions 5 and 5*a*. Recesses 9 house the lock-up assemblies 10 of this invention. The assemblies 10, shown larger in FIG. 2, are used to tighten and lock the relatively thin printing plate on the printing cylinder surface 4.

In addition to recesses 9, a longitudinal plate receiving gap 8, extends across the surface of plate cylinder 2 for use in conjunction with lock-up assemblies 10 as will be described in greater detail. Gap 8 is parallel to the axis of rotation of the print cylinder for accommodating the edge or edges of the printing plate. Gap 8 is located in the periphery of plate cylinder 2, that is, in surface 4, and it opens into a channel or bore which houses tensioning spindle or reel rod 14. This channel indicated by numeral 15 receives reel rod 14, as shown in FIG. 2, where reel rod 14 can best be seen. The reel rod 14 is substantially in the form of a cylindrical rod carrying a longitudinal peripheral slot 20 fabricated to receive an edge of the printing plate. Reel rod 14 is adapted for partial rotation within the channel 15 to enable the lock-up means to operate. To this end axial shafts or reel rod studs 22 and 23 form the ends of the reel rod 14. Reel rod 14 is thus supported in its channel 15 for rotation to tighten the printing plate. To effect this tightening rotation hexagon collars 25 and 27 are secured to the square ends of the generally circular studs 22 and 23 respectively (FIG.2).

Referring again to FIG. 2, it has been pointed out that the printing plate locking operation entails aligning slot 20 in reel rod 14 with gap 8 in plate cylinder 2, and holding this alignment while wrapping and attaching the printing plate around the plate cylinder. It is this operation that is no easy undertaking. To this end, the plate cylinder 2 herein carries a lockup assembly adapted to maintain the alignment while the printing plate is being securely attached on the plate cylinder surface. This clamping assembly, thus, is a matter of importance herein.

Figure 4:
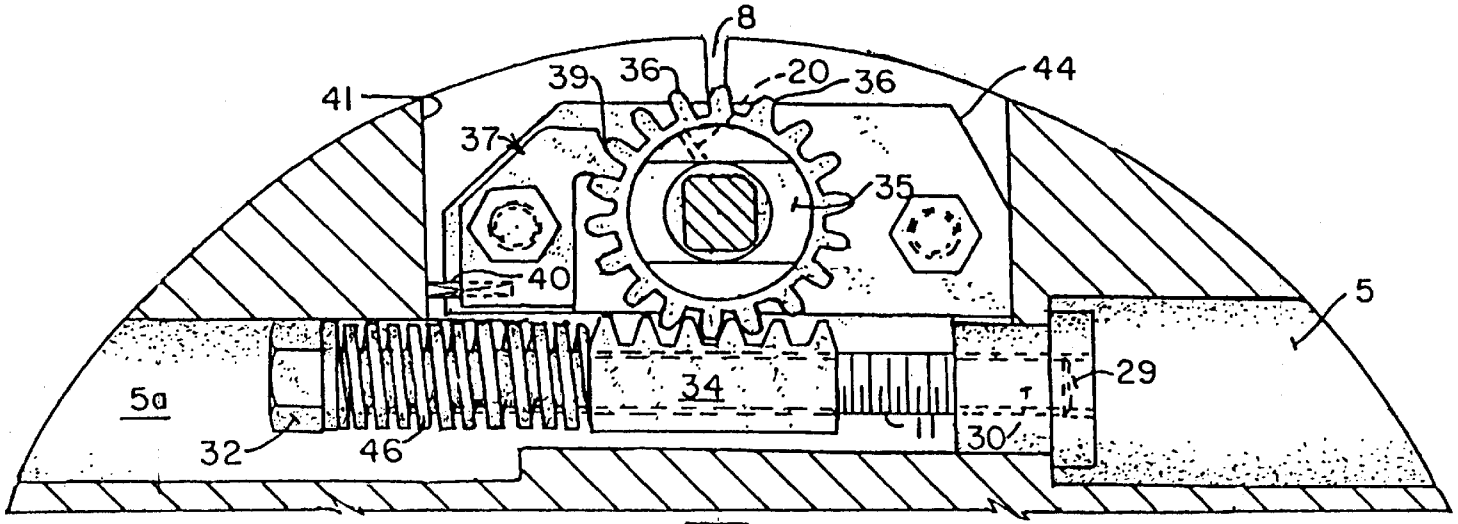
FIG. 4 is a cross-sectional view taken through 4—4 of FIG. 3 showing the rack and pinion associated with the reel rod of FIGS. 1 and 2.
Figure 3:
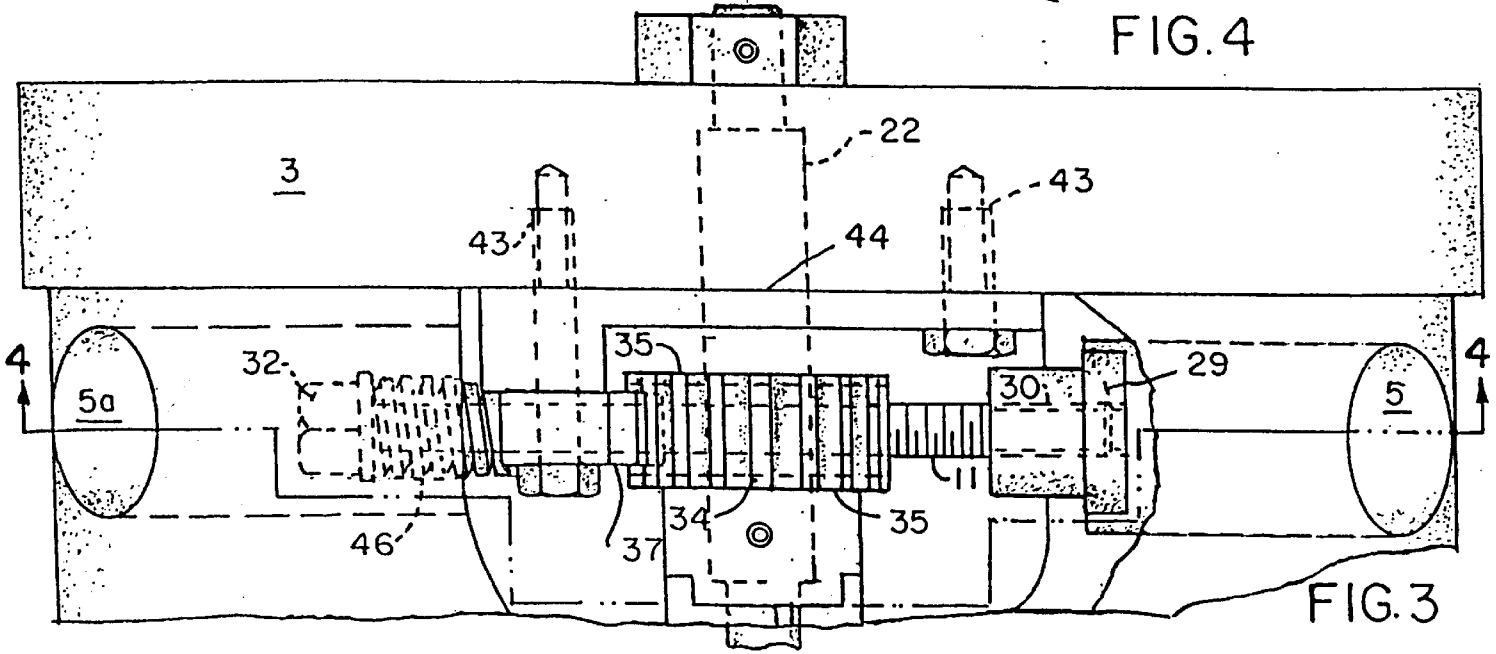
FIG. 3 is a schematic top view illustrating the rack and pinion mechanism of the invention.

One embodiment of the clamping assembly will now be described in detail with reference to FIGS. 3 and 4. As shown, the contemplate clamping or locking assembly (10 in FIG 1) includes both a rack and pinion mechanism and a pawl and ratchet mechanism, shown perhaps more clearly in FIG. 4. This assembly is housed in recess 9 and includes a base plate 44 attached by bolts 43 to bearer ring 3 (FIG.3). The rack and pinion mechanism includes a pinion gear 35 with teeth 36 and a bolt 30 having a threaded bushing 29 and a hexagon head 32 accessible through counter bore portions 5 and 5*a* respectively (FIGS. 1 and 3). A rack member 34 is carried by bolt 30, and that rack is in engagement with teeth 36 of pinion 35. It can be seen that rack member 34 can be driven by pinion 35, or, if it is urged forward, the rack can rotate the pinion. Rack 34 is thus adapted to drive or to be driven by pinion 35 mounted on shaft end 22 (FIG. 3) of the tensioning spindle. To this end bolt 30, while having threads 11 at one end, carries a compression spring 46 on its other end. This spring urges rack member 34 away from bolt head 32 toward bushing 29.

Operating in conjunction with pinion 35 is a pawl 37. In conjunction with this pawl 37, which provides a detent, the pinion gear operates like a pawl and ratchet. The pinion gear thus has two functions, one cooperating with the rack 34, and the other as a ratchet cooperating with the pawl 37. When the gap 8 in the plate cylinder 2 is in alignment with the reel rod 14, pawl 37 is pressed between two adjacent pinion gear (ratchet) teeth 36. Pawl 37, as shown in FIG. 4, is mounted for such engagement by one of the bolts 43 fixed in bearer ring 3, and includes a compression spring 40. When the compression spring abuts wall 41, spring 40 exerts a force on pawl 37, tending to urge it out of engagement with gear teeth 36. However, the force of spring 46 at alignment causes the pressure of tooth 36 at interface 39 to hold the pawl in place while the printing plate is installed. During alignment, then, the pawl is pressed or held between two teeth.

Having described the components of the clamping assembly the lock up operation can now be considered in greater detail. By the use of a suitable tool on lock nut 25 or 27 (FIG. 2), the reel rod 14 can be rotated. When reel rod 14 is turned in a clockwise direction, pinion 35, as seen in FIG. 4, will urge rack 34 toward bolt head 32, thereby compressing spring 46. Reel rod 14 is partially rotated until reel rod slot 20 is visually aligned with printing plate cylinder gap 8 as shown in FIG. 8. When this visual alignment is achieved pivotally mounted pawl 37 is pressed by the operator into the space between adjacent teeth 36 as illustrated in FIG. 4. Both of the operator's hands are then free so that end 51 of plate 50 bearing the material to be printed can be hooked into gap 8 and wrapped around the plate cylinder 2. The plate 50 is then stretched and pulled around the cylinder 2 so that it envelops the printing surface of the plate cylinder for insertion of the other end 52 into the cylinder gap 8 and into aligned slot 20 in the reel rod 14. (See FIG. 2). To lock the printing plate in place around plate cylinder 2, reel rod 14 is rotated a small amount further in the clockwise direction, compressing spring 46 (FIG. 3) slightly more. When this occurs, detent or pawl 37 is acted on by spring 40 which urges the pawl from the tooth zone. This disengagement of pawl 37 permits spring 46 to urge rack 34 toward the bushing 29 in FIG.4. Concomitant counterclockwise rotation of pinion gear 35 then locks the plate in place as shown in phantom outline in FIG. 8.

In another embodiment of the invention it is unnecessary to visually align plate cylinder gap 8 and reel rod slot 20. The overall structure of the plate cylinder is the same as for the first embodiment and accordingly the same numerals will be used to designate the same parts.

Figure 6:
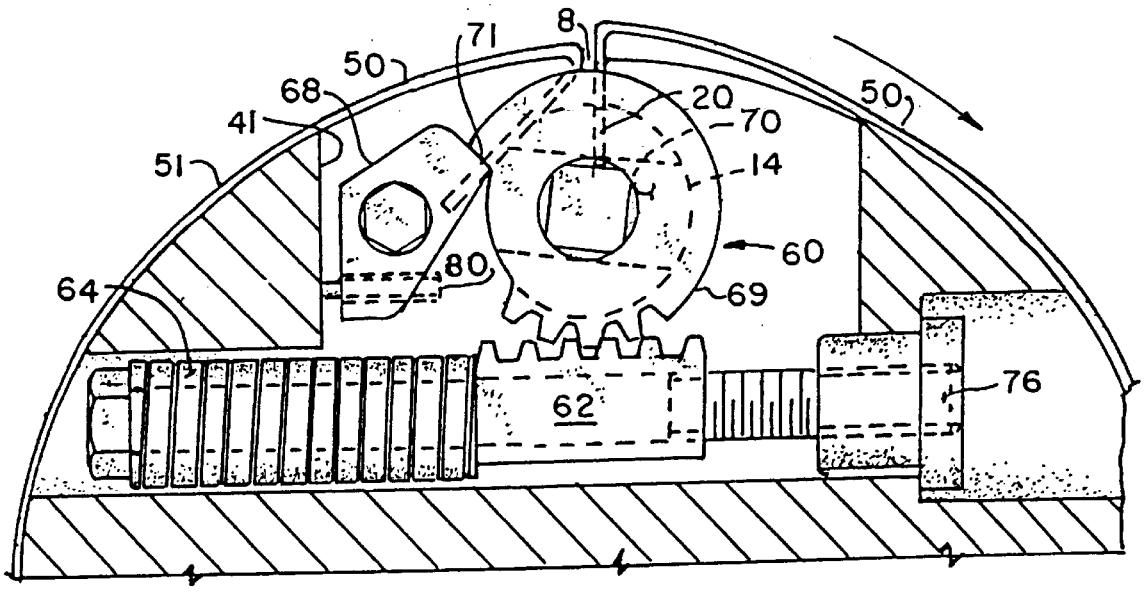
FIG. 6 is a cross-sectional view taken through line 6—6 of FIG. 5 showing the modified rack and pinion means.
Figure 7:
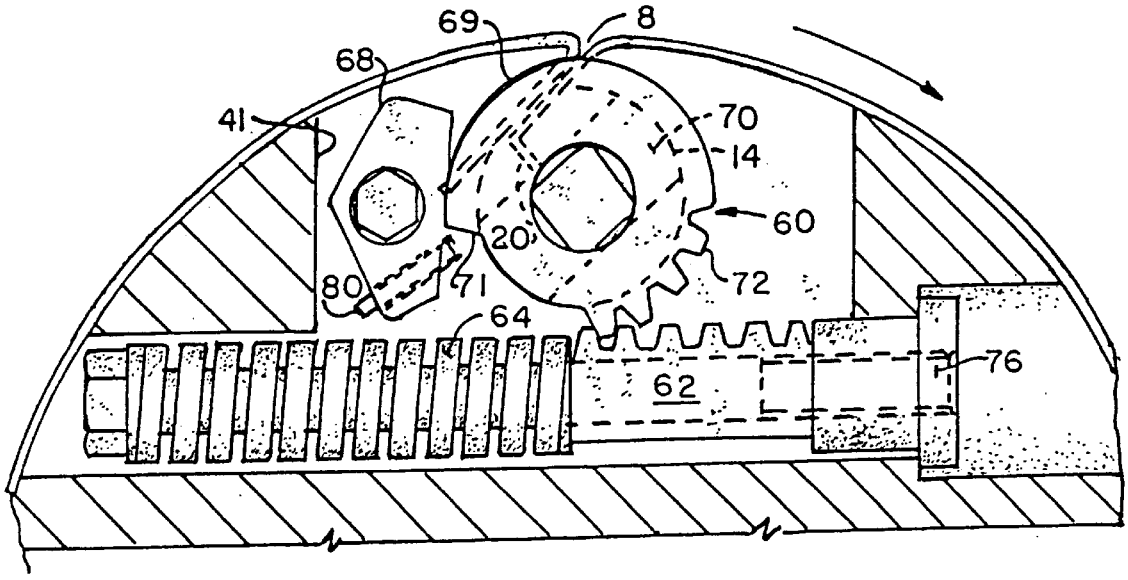
FIG. 7 is a similar view to FIG. 6 but showing the pawl in a disengaged position.

For an explanation of this embodiment we shall refer to FIGS. 5–8. As in the previous embodiment, the recess 9 in the plate cylinder 2 (FIG. 1) houses this preferred lock-up assembly 60, as shown in FIGS. 6 and 7, and the plate cylinder is provided with a gap 8 to be aligned with the slot 20 in the reel rod 14. It is the rack and pinion mechanism which is different in this embodiment.

As shown in FIGS. 5–8, the pinion on the end shaft of the reel rod 14 is, in effect, a segmental toothed pinion 70, providing a single shouldered ratchet gear. What is meant by a segmental toothed pinion can be seen in FIGS. 6 and 7. The pinion 70 does not have gear teeth all around its circumference. Rather, the pinion 70 includes only a sufficient number of teeth 72 in one segment to advance the rack 62 the distance necessary to almost completely compress spring 64 as previously explained. What is meant by almost completely compress spring 64, as also pointed out, is that the reel rod 14 is rotated a small amount further in the clockwise direction so that a spring can force the pawl 68 from the ratchet, in this instance out from under a single shouldered gear section. The single shoulder provides an abutment 71 and is so spaced or positioned in the periphery of pinion 70 that when pawl 68 engages abutment 71 as shown in FIG. 6, the reel rod slot 20 is automatically aligned with plate cylinder gap 8. In this embodiment, then, it is not necessary to visually align the two.

Prior to considering the operation of this embodiment of the invention it is to be pointed out that as in the previous embodiment the pawl 68 includes a compression spring, in this aspect, spring 80 which is similar to spring 40. Again the spring abuts the wall 41 and exerts a force on the pawl 68, tending to urge it out of engagement with the abutment 71. As before, the force of the rack spring 64 at alignment causes the pressure of abutment 71 to hold the pawl 68 in place.

There are several ways an operator can employ to align plate reel rod slot 20 with plate cylinder gap 8. While rotating reel rod 14 the operator can depress pawl 68 allowing it to ride on the smooth peripheral surface 69 of pinion 70 (FIG. 7). When the operator feels the pawl 68 slip or snap under abutment 71 he will stop rotating the reel rod 14 (FIG. 6). Because the abutment 71 is so positioned that it engages the pawl 68 when reel rod slot is aligned with plate cylinder gap the operator knows he has an aligned condition. Since the lock-up assembly 60 is visible in the recess 9 the operator can also turn the reel rod until he sees the abutment 71 move by the pawl 68 (FIG. 7). He can then press the pawl under the abutment and allow spring 64 to hold it until the plate is in position as shown in FIG. 6. At this point for all practical purposes spring 64 is sufficiently compressed. After the printing plate 50 is in place, as in FIG. 8, reel rod 14 is rotated a small amount further so that spring 80 can push pawl 68 out from under abutment 71. When the pawl 68 is released spring 64 will drive rack member 62 toward the bushing 76, concomitantly rotating the reel rod to secure the edge 52 of the printing plate which was inserted in gap 8 and slot 20.

Another method an operator can employ to align the gap and slot without looking depends on the size or tension of spring 64. The compression of spring 64 and its tension are balanced so that the rack moves only a desired amount in each direction. As an example the compression of spring 64 can be such that when it is compressed to its maximum the abutment 71 will be, say, one-fourth inch beyond alignment. The pawl can be depressed and the reel rod allowed to back up. There will, then, be one-fourth inch movement to allow spring 80 to urge the pawl out of engagement after the plate 50 is installed. It is also preferred that the tension of spring 64 be such that it will advance rack member 62 to the appropriate locking position as the operator holds the plate in place. This will ensure that the printing plate is not damaged.

It can be seen that by this embodiment of the invention a particularly effective lock-up assembly is provided for tightening a printing plate around a plate cylinder which is rotatable about an axis of rotation in an offset printing machine. Heretofore it has been necessary to visually align the reel rod slot with the plate cylinder gap. Herein the alignment is automatic, requiring no visualization. In its broader aspect a clamping device is provided herein which renders the alignment easier than known lock-up assemblies, and frees up both of the operator's hands so that the plate film bearing the material to be printed can be easily placed on the plate cylinder.

A significant improvement over the prior lock-up devices is that it is a simple matter, because of the substantial symmetry of the system as a whole, to provide a lock-up device at each end. Thus, not only can the operation be performed by only one operator at one end, but there is the added advantage that the operator may select at which end he wishes to work.

Having been given the teachings of this invention, ramifications and variations of the invention will occur to those in the art. As an example a brake unit (not shown) can be included to hold the reel rod 14 in place while the printing plate 50 is being wrapped around it and inserted in the gap 8 and slot 20. It can also be seen that whereas the studs at the end of the reel rods are adapted to receive a wrench, various means can be employed to turn the reel rod to align the plate cylinder gap and the slot. Further, in the second embodiment the pawl 68 could be spring loaded to engage the abutment 71 automatically, but it would have to include a temporary retention means to hold it back when released since the operator must use his hands to hold the plate 50 as the reel rod 14 moves back to its normal locking position. As another variation the lock-up assembly 60 could be attached to only one end of the reel rod with appropriate collar bearings, depending upon whether the operator can work from one side of the press.

Instead of the means described for installing the lock-up or clamping assembly 60 in the recess 9 in the printing plate cylinder, other means will occur to those in the art. It will also be appreciated that instead of an abutment 71 the peripheral surface of pinion 70 can be provided with a single tooth, boss, or jog positioned to coact or accept the pawl when the plate cylinder gap and reel rod slot are aligned. Such modifications are deemed to be within the scope of this invention.

I claim as my invention:

1. A lock-up assembly for tightening a printing plate around a plate cylinder which is rotatable about an axis of rotation in an offset printing machine, the lock-up assembly including a plate cylinder whose surface is provided with a peripheral recess in the form of a longitudinal gap in the surface of the plate cylinder, opening into a channel below it adapted to house a tensioning spindle, the plate cylinder gap being adapted to receive leading and trailing edges of a printing plate and to hold one of those edges, a tensioning spindle within said channel mounted for partial rotation about an axis parallel to the cylinder axis of rotation, the tensioning spindle having a printing plate edge receiving slot adapted, when the receiving slot is in alignment with the plate cylinder longitudinal gap, to engageably receive and hold the other edge of the printing plate, a pinion mounted on an end of the tensioning spindle and adapted to rotate therewith, a rack adapted to be urged forward by teeth of the pinion when the tensioning spindle is partially rotated to align the tensioning spindle receiving slot with the plate cylinder longitudinal gap, a rack spring means adapted to oppose the forward urging of the rack during the partial rotation of the spindle, a pawl mechanism adapted to engage the pinion to hold the tensioning spindle in place after the alignment so an edge of the printing plate can be inserted in the tensioning spindle receiving slot, and pawl mechanism release means allowing the rack spring means, through the rack, to rotate the tensioning spindle to a locked position holding the printing plate in place.

2. The lock-up assembly of claim 1 wherein the rack spring means is so sized that it can be compressed only slightly after the pawl mechanism engages the pinion.

3. The lock-up assembly of claim 1 wherein the tension of the rack spring means and its compressive strength are adapted to control the movement of the rack.

4. The lock-up assembly of claim 1 wherein the rack spring means is calibrated to exert on the rack the force required to return the pinion to its locked position without damaging the printing plate.

5. A lock-up assembly of claim 1 wherein means are provided for the partial rotation of the tensioning spindle by a single operator from either end of the plate cylinder.

6. A lock-up assembly for tightening a printing plate around a plate cylinder which is rotatable about an axis of rotation in an offset printing machine, the lock-up assembly including a plate cylinder whose surface is provided with a peripheral recess in the form of a longitudinal gap in the surface of the plate cylinder, opening into a channel below it adapted to house a tensioning spindle, the plate cylinder gap being adapted to receive leading and trailing edges of a printing plate and to hold one of those edges, a tensioning spindle within said channel mounted for partial rotation about an axis parallel to the cylinder axis of rotation, the tensioning spindle being in the form of a cylinder having rod ends at each end as axial shafts therefor and a printing plate edge receiving slot adapted to engageably receive and hold the other edge of a printing plate, rack and pinion means adapted to position and rotate the tensioning spindle, the rack being mounted within the plate cylinder to coact with the pinion, the pinion being secured to at least one said spindle axial shafts so that it rotates with the tensioning spindle, the pinion having gear teeth in one segment in its periphery and an abutment in another segment, the number of teeth in the segment being sufficient to operate the rack when the tensioning spindle is rotated from a locked position, to a position wherein the spindle receiving slot and the plate cylinder gap are aligned, means for so rotating the tensioning spindle, a rack spring means adapted to exert a force on the rack resisting spindle movement to the aligned position, a spring releasible pawl, adapted, when the spindle reaches the aligned position to act on the abutment to retain the spindle in the aligned position during insertion of the printing plate edge, and adapted, when released, to allow the rack spring means to act on the rack to return the spindle to the locked position.

7. The lock-up assembly of claim 6 wherein the rack spring means is so sized that it can be compressed only slightly after the pawl engages the abutment.

8. The lock-up assembly of claim 6 wherein the tension of the rack spring means and its compressive strength are adapted to control the movement of the rack.

9. The lock-up assembly of claim 6 wherein the rack spring means is calibrated to exert on the rack the force required to return the pinion to its locked position without damaging the printing plate.

10. A lock-up assembly of claim 2 wherein means are provided for the partial rotation of the tensioning spindle by a single operator from either end of the plate cylinder.

* * * * *